United States Patent [19]

Skinner

[11] Patent Number: 4,467,531

[45] Date of Patent: Aug. 28, 1984

[54] METHOD AND APPARATUS FOR CONTROLLING THE DISCHARGE OF PARTICULATE SOLIDS FROM AN EXPANDED BED OF SUCH SOLIDS

[75] Inventor: James L. Skinner, Richardson, Tex.

[73] Assignee: Atlantic Richfield Company, Los Angeles, Calif.

[21] Appl. No.: 367,201

[22] Filed: Apr. 12, 1982

[51] Int. Cl.[3] ..... F26B 3/16; F26B 17/14

[52] U.S. Cl. ..... 34/10; 34/25; 34/57 A; 34/57 C; 34/168

[58] Field of Search ..... 34/10, 57 A, 57 C, 25, 34/56, 167, 168, 236; 137/625.28, 601; 432/15, 58; 110/245; 122/4 D

[56] References Cited

U.S. PATENT DOCUMENTS

| | | | |
|---|---|---|---|
| 4,203,804 | 5/1980 | Janning et al. | 34/57 A |
| 4,253,492 | 3/1981 | Sullivan | 137/601 |
| 4,258,005 | 3/1981 | Ito et al. | 432/58 |

FOREIGN PATENT DOCUMENTS

| | | | |
|---|---|---|---|
| 950033 | 2/1964 | United Kingdom | 34/57 C |

*Primary Examiner*—Larry I. Schwartz
*Attorney, Agent, or Firm*—F. Lindsey Scott

[57] ABSTRACT

An apparatus for controlling the discharge of particulate solids through a discharge opening from a zone containing an expanded bed of particulate solids, the apparatus comprising a plurality of vertical doors positioned to open and close the discharge opening with the doors being adapted to open and close by rotation about a vertical axis; a mounting means to support the doors in position; and a controller adapted to control the opening and closing of the doors.

7 Claims, 3 Drawing Figures

METHOD AND APPARATUS FOR CONTROLLING THE DISCHARGE OF PARTICULATE SOLIDS FROM AN EXPANDED BED OF SUCH SOLIDS

This invention relates to an apparatus for controlling the discharge of particulate solids from an expanded bed.

This invention further relates to an improvement in methods for drying particulate solids in an expanded bed whereby solids are removed from the expanded bed by the use of vertical doors.

In many industrial applications, particulate solids are dried in expanded beds. Expanded bed as used herein refers to ebullated beds, fluidized beds, semi-fluidized beds, and the like. Such beds generally comprise solids which are agitated by the flow of gas upwardly through the solids so that the apparent volume of the bed of solids is substantially greater than the volume of the solids with no gas flowing upwardly through the solids. The use of such expanded beds is well known to those skilled in the art and, as indicated, such expanded beds are used in many instances for drying particulate solids.

In many instances, coal, as mined, contains undesirably high quantities of water for transportation and use as a fuel. This problem is common to all coals, although in higher grade coal such as anthracite and bituminous coal, the problem is less severe because the water content of the coal is normally lower and the heating value of coal is higher. The situation is different with respect to lower grade coals such as subbituminous, lignite, and brown coals. Such coals, as produced, typically contain from about 25 to about 65 weight percent water. While many such coals are desirable as fuels because of their relatively low mining cost, and since many such coals have a relatively low sulfur content, the use of such lower grade coals as a fuel has been greatly inhibited by the fact that, as produced, they typically contain a relatively high percentage of water. The drying required with such low rank coals is a deep drying process for the removal of surface water plus the large quantities of interstitial water present in such low rank coals. When higher grade coals are dried, the drying is commonly for the purpose of drying the surface water from the coal particle surfaces but not interstitial water, since the interstitial water content of the higher rank coal is relatively low.

In either instance, a commonly used method comprises the use of a coal drying zone in which the particulate coal is supported above a grate such as a slotted grate, moving grate, or the like, in an expanded bed with a heated gas flowing upwardly through the expanded bed to dry the coal solids.

In the drying of coal solids as discussed above, as well as in the drying of other particulate solids, a continuing problem is the regulation of the flow of particulate solids across the grate so that the solids are uniformly discharged from the discharge side of the vessel at a desired rate. Desirably, the flow across the grate is as nearly "plug" flow as possible. In other words, any given particle moves across the grate at the same rate and is exposed to the same conditions as any other solid particle. This is an idealized situation, but desirably, it is closely approximated for optimum dryer operation.

In prior art attempts to control the flow of particulate solids from expanded beds wherein the solids were dried, horizontal doors have been used to regulate the discharge of the solids. Normally, the door is subjected to a predetermined torque to open the door a desired distance to accomplish the removal of a desired quantity of solids. Such approaches have resulted in the removal of particulate solids at a desired rate, but not uniformly across the depth of the expanded bed.

Accordingly, an improved method for controlling the discharge of particulate solids from expanded beds has been sought. It has now been found that solids are uniformly discharged from all depths of an expanded bed by the use of an apparatus which comprises:

(a) a plurality of vertical door means pivotally mounted to open and close the discharge opening with the doors being adapted to open and close by rotation about a vertical axis;

(b) a mounting means to support the doors in position to open and close the discharge opening; and (c) a controller means adapted to control the opening and closing of the doors.

Such an apparatus is useful in processes for the drying of coal as discussed above, as well as in processes for drying other particulate solids in expanded beds.

In the description of the Figures, the same numbers will be used throughout to refer to the same or similar components.

Figure 1:
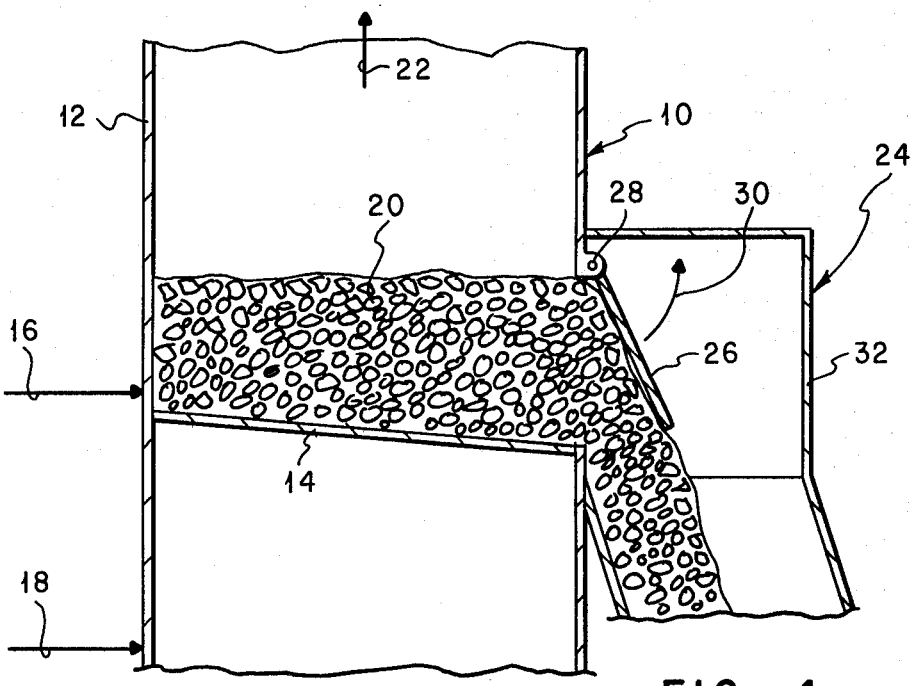
FIG. 1 PRIOR ART
FIG. 1 is a cross-sectional schematic diagram of a coal drying vessel wherein the solids discharge is controlled by the use of a horizontal door as known to the art.

In FIG. 1, a dryer 10 is shown. Dryer 10 comprises a vessel 12 including a grate 14 above which particulate solids 20 are positioned in an expanded bed. Coal is charged to vessel 12 through an inlet 16 which may be any suitable solids handling system such as a vibrating table or other type of solids feeder. Air is injected into vessel 12 through a line 18 and, in many embodiments, is heated air. In some instances, fuel may also be injected beneath grate 14 with the combustion gases forming the hot gas which passes upwardly through grate 14 and solids 20. The exhaust gases from the drying process are recovered through a line 22 and passed to fine solids removal, recycling, clean-up, or the like, as known to those skilled in the art. Such drying processes, in general, are considered to be known to those skilled in the art. Vessel 12 as shown in FIG. 1 includes a coal discharge chute 24 which comprises a casing 32 through which particulate solids are recovered from vessel 12. The flow of solids from vessel 12 is regulated by a horizontal gate 26. Gate 26 is pivotally mounted at a horizontal connection 28. In the operation of gate 26, torque as shown by arrow 30 is applied as required to maintain gate 26 in a desired position. It will be clear upon a review of FIG. 1 that solids at the top of the expanded bed in vessel 12 have a much smaller area through which they may escape from vessel 12 than do solids at the bottom of the expanded bed above grate 14. In general, the solids at the top of the expanded bed are those lighter solids which either are smaller in size or have already been dried to a substantial degree. The heavier solids at the bottom of the expanded bed are normally the larger particles or those particles that have not yet been dried to the same degree as those particles at the top of the expanded bed. As a result, the particles, both the larger particles and the wetter particles, are to be expected nearer the bottom of the expanded bed and, in the use of the apparatus shown in FIG. 1, will be those particles which are most likely to escape vessel 12 in a short time interval. Accordingly, the use of gate 26, while it is effective in establishing a desired flow rate, is not effective in achieving plug flow across the expanded bed in vessel 12 or in removing solids uniformly across the depth of the expanded bed.

Figure 2:
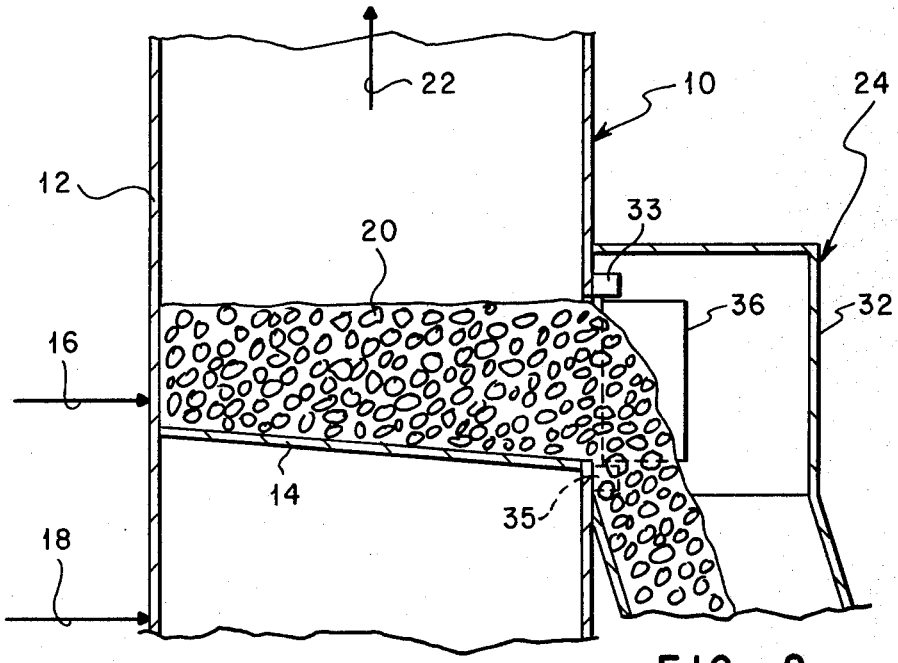
FIG. 2 is cross-sectional schematic diagram of a similar dryer including an embodiment of the apparatus of the present invention.

In FIG. 2, an embodiment of the apparatus of the present invention is shown. An upper mounting member 33 and a lower mounting member 35 are positioned above and below the discharge from the expanded bed in vessel 12. A vertical door 36 is positioned to open and close to regulate the flow of particulate solids from the expanded bed in vessel 12. In the operation of the apparatus shown in FIG. 2, a plurality of doors 36, only one of which is shown, are positioned to open and close to thereby open and close the discharge opening for particulate solids from vessel 12. When doors 36 are opened, flow is unimpeded from the top, middle, or bottom of the expanded bed. Solids 20, in any portion of the expanded bed, can freely flow through the discharge opening. When it is desired to stop flow, doors 36 are closed. Desirably, flow is regulated by fully opening or fully closing doors 36 so that flow from the expanded bed is unimpeded when solids are to be discharged. It is readily seen that the use of the apparatus shown in FIG. 2 closely simulates plug flow through the ebullated bed present in vessel 12 and results in the uniform removal of particulate solids from all levels of the expanded bed.

Figure 3:
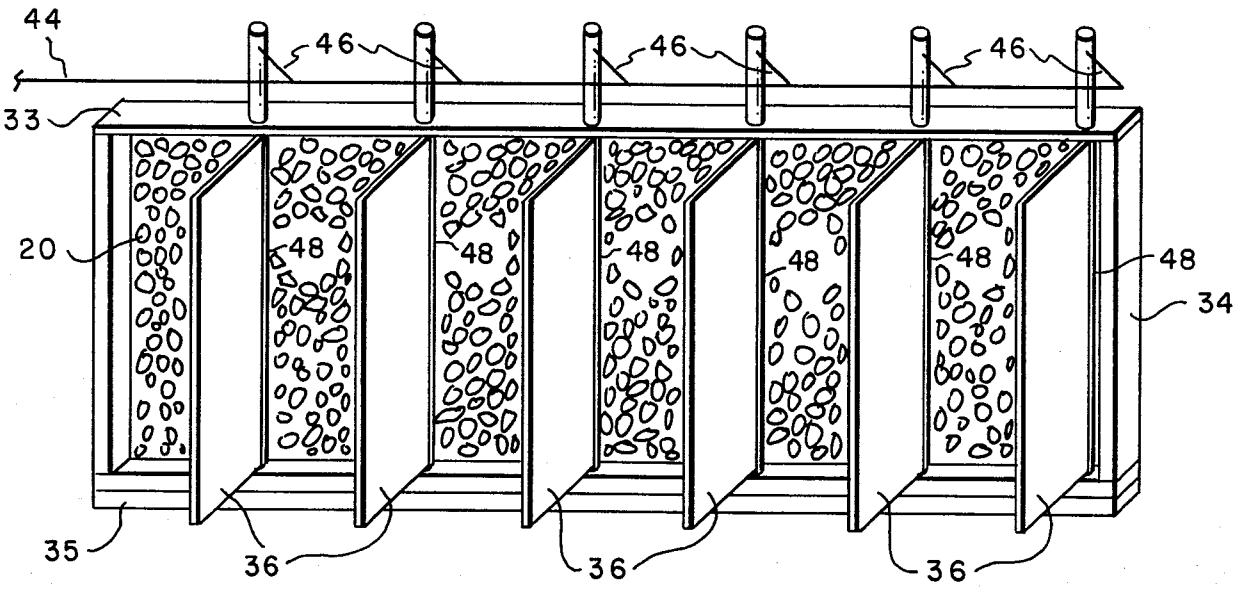
FIG. 3 is an end view of an embodiment of the present invention shown in FIG. 2.

In FIG. 3, the mounting members and doors 36 are shown in greater detail. A frame 34 is conveniently used to mount the apparatus of the present invention in place over the discharge opening from an expanded bed zone. Frame 34 includes upper mounting member 33 and lower mounting member 35. Doors 36 are supported on vertical support members 48 which are rotatably supported in upper mounting member 33 and lower mounting member 35. As shown in FIG. 3, support members 48 are rods which are supported by a suitable support means such as thrust bearings (not shown) and journal bearings (not shown) in lower mounting member 35 and by journal bearings (not shown) in upper mounting member 33. Doors 36 are desirably rigidly mounted on support members 48 so that rotation of support members 48 results in rotation of doors 36. Support members 48 desirably extend a distance above upper mounting member 33. Control rods 46 are positioned on each of support members 48 and join support members 48 to a push rod 44 which is used to open and close doors 36. Push rod 44 is desirably rotatably attached to control rods 46, so that when push rod 44 is moved, doors 36 are opened or closed. Control means (not shown) such as a variable time or the like can be used to open and close doors 36 at any selected interval or frequency to achieve the removal of particulate solids from the expanded bed at a desired rate. It is clear, upon observation of FIG. 3, that when doors 36 are opened, the flow of solids from the expanded bed is unimpeded and solids can be recovered with equal freedom from the upper, middle, or lower portions of the expanded bed. Similarly, when it is desired to close doors 36, since expanded beds tend to behave as fluids rather than solids, doors 36 are readily closed to stop flow until it is desired to remove additional quantities of solids.

While the apparatus of the present invention is useful in many applications, one application in which it is considered to be particularly suitable is in conjunction with methods for drying particulate solids such as coal with hot gases. Such processes are well known to those skilled in the art, however, the apparatus used to regulate the flow from such vessels heretofore has not provided the uniform solids recovery across the full width of the expanded bed provided by Applicant's claimed apparatus.

A plurality of doors are desirably used. The doors can be of substantially any size although it is preferred that the doors be at least five times, and preferably ten times, the diameter of the largest particulate solids in width. Preferably, the doors are even wider. Similarly, support members 48 could be joined to doors 36 in the middle or at positions other than at one edge, although it is greatly preferred that support members be joined to an edge of doors 36. The apparatus can be constructed of materials known to those skilled in the art for use in such applications. Similarly, a variety of means for opening and closing doors 36 could be used, although the apparatus set forth is considered to be a preferred embodiment.

Having thus described the invention by reference to its preferred embodiments, it is pointed out that the embodiments described are illustrative rather than limiting in nature, and that many variations and modifications are possible within the scope of the present invention. Many such variations and modifications may be considered obvious and desirable by those skilled in the art based upon a review of the foregoing description of preferred embodiments.

Having thus described the invention, I claim:

1. In a method for drying particulate coal solids by charging said solids to a solids drying zone; supporting said solids above a grate means in said drying zone, said grate being adapted to the flow of a gas upwardly through said grate and said solids; passing a gas upwardly through said grate and said solids to maintain said solids in an expanded bed above said grate and recovering dried solids from said expanded bed through a discharge opening, the improvement comprising positioning a plurality of vertical door means across said discharge opening, said doors being adapted to open about a vertical axis and controlling the discharge of said solids from said expanded bed by opening and closing said doors at a rate sufficient to maintain said expanded bed at a depth no greater than the height of said discharge opening so that said solids are uniformly discharged from all depths of said expanded bed.

2. The improvement of claim 1 wherein said doors are opened and closed at selected frequencies to maintain said expanded bed at a desired depth.

3. In a vessel for drying particulate coal solids, said vessel including means for charging said solids to said vessel; a grate positioned within said vessel for supporting said solids said grate being adapted to the flow of a gas upwardly through said grate and said solids; means for passing a gas upwardly through said grate and said solids to maintain said solids in an expanded bed above said grate and means for recovering dried solids from said expanded bed through a discharge opening, an improvement comprising: an apparatus for controlling the discharge of particulate solids from said expanded bed, said apparatus including:

(a) a plurality of vertical door means pivotally mounted to open and close said discharge opening, said doors being adapted to open and close by rotation about a vertical axis;

(b) a mounting means to support said doors in position to open and close said discharge opening; and (c) a controller means adapted to control the opening and closing of said doors at a rate sufficient to maintain said expanded bed at a depth no greater then the height of said discharge opening and so that said solids are uniformly discharged from all depths of said expanded bed.

4. The improvement of claim 3 wherein said doors are mounted on rotatable support members.

5. The improvement of claim 4 wherein said mounting means includes an upper mounting member and a lower mounting member, said mounting members including means for rotatably supporting said support members.

6. The improvement of claim 4 wherein said controller means includes at least one control rod means positioned on each said support member to connect each said support member to a push rod means adapted to open and close said doors by movement of said control rods to rotate said support members and said doors.

7. The improvement of claim 3 wherein said doors are at least five times the diameter of the largest particulate solids in width.

* * * * *